United States Patent [19]

Sirvet

[11] 4,037,530

[45] July 26, 1977

[54] MANDREL TRIP MECHANISM FOR CAN PRINTERS

[75] Inventor: Enn Sirvet, Washington Township, Bergen County, N.J.

[73] Assignee: Coors Container Company, Golden, Colo.

[21] Appl. No.: 636,402

[22] Filed: Dec. 1, 1975

[51] Int. Cl.[2] ..... B41F 17/22

[52] U.S. Cl. ..... 101/40; 101/247

[58] Field of Search ..... 101/40, 39, 38 A, 38 R, 101/247; 118/4, 8, 230, 319

[56] References Cited

U.S. PATENT DOCUMENTS

| | | | |
|---|---|---|---|
| 3,356,019 | 12/1967 | Zurick | 101/39 |
| 3,388,686 | 6/1968 | Cohan | 101/40 X |
| 3,496,863 | 2/1970 | Cvacho et al. | 101/40 |
| 3,613,571 | 10/1971 | Russell et al. | 101/40 |
| 3,665,853 | 5/1972 | Hartmeister et al. | 101/38 R X |
| 3,851,579 | 12/1974 | Zurick | 101/39 |

*Primary Examiner*—Clifford D. Crowder
*Attorney, Agent, or Firm*—Bertha L. MacGregor; Kyle W. Rost

[57] ABSTRACT

A pocket mandrel wheel having mandrels mounted on mandrel arms that pivot to move the mandrels laterally to prevent the mandrels from contacting an associated printing wheel. The mandrel arms are attached to the mandrel wheel by a pivot arm that controls the radius of the mandrels line of motion as the mandrel wheel rotates. The pivot arm causes the mandrel arm to rotate the mandrel in response to an electronic system that detects improperly seated cans on the mandrels. The pivot arm rests against an interposer block having a recessed step, and the mandrel is withdrawn when the block is moved in response to a signal from the electronic system so that the pivot arm rests against the recessed portion of the block. The movement of the block is controlled by a mechanical system that moves the pivot arm away from the block prior to the time when the mandrel may be tripped.

10 Claims, 5 Drawing Figures

MANDREL TRIP MECHANISM FOR CAN PRINTERS

BACKGROUND OF THE INVENTION

Continuous can printing and transfering mechanisms require accurate seating of cans on mandrels preparatory to the printing operation, not only to ensure perfect transfer of the image from the printing blanket to the can but also to prevent contact between the mandrel and the image applicator. Such unwanted contact occurs when the can is improperly seated and when a can is missing and the mandrel is exposed. An electronic sensor is provided to detect faulty seating of a can on its mandrel or absence of a can on each mandrel.

This invention relates to mandrel tripping means whereby a mandrel on which a can is improperly seated or a mandrel without a can is moved out of printing position. The invention also relates to means for blowing an improperly seated can off the mandrel.

The invention is an improvement on prior art malfunction correcting means such as the printing blanket retracting mechanism of U.S. pat. No. 3,261,281, issued to Ruben J. Hartmeister, and such as the spindle moving mechanism of U.S. Pat. No. 3,766,851, issued to Enn Sirvet et al.

SUMMARY OF THE INVENTION

The invention relates to a high speed continuous printer for decorating cans that are mounted on mandrels for the printing operation. More specifically, it relates to a mechanism for moving a mandrel with no can or an improperly seated can out of printing position so that neither the mandrel nor the printing blanket suffers harmful contact with the other.

An object of the invention is to trip a mandrel with a missing or improperly seated can out of printing position without disturbing the printing operation as it relates to preceding and following cans in the continuous printing operation. Another object is to return a mandrel to printing position after it has been tripped and any misseated can ejected, so that the future printing operation continues at full capacity.

Figure 1:
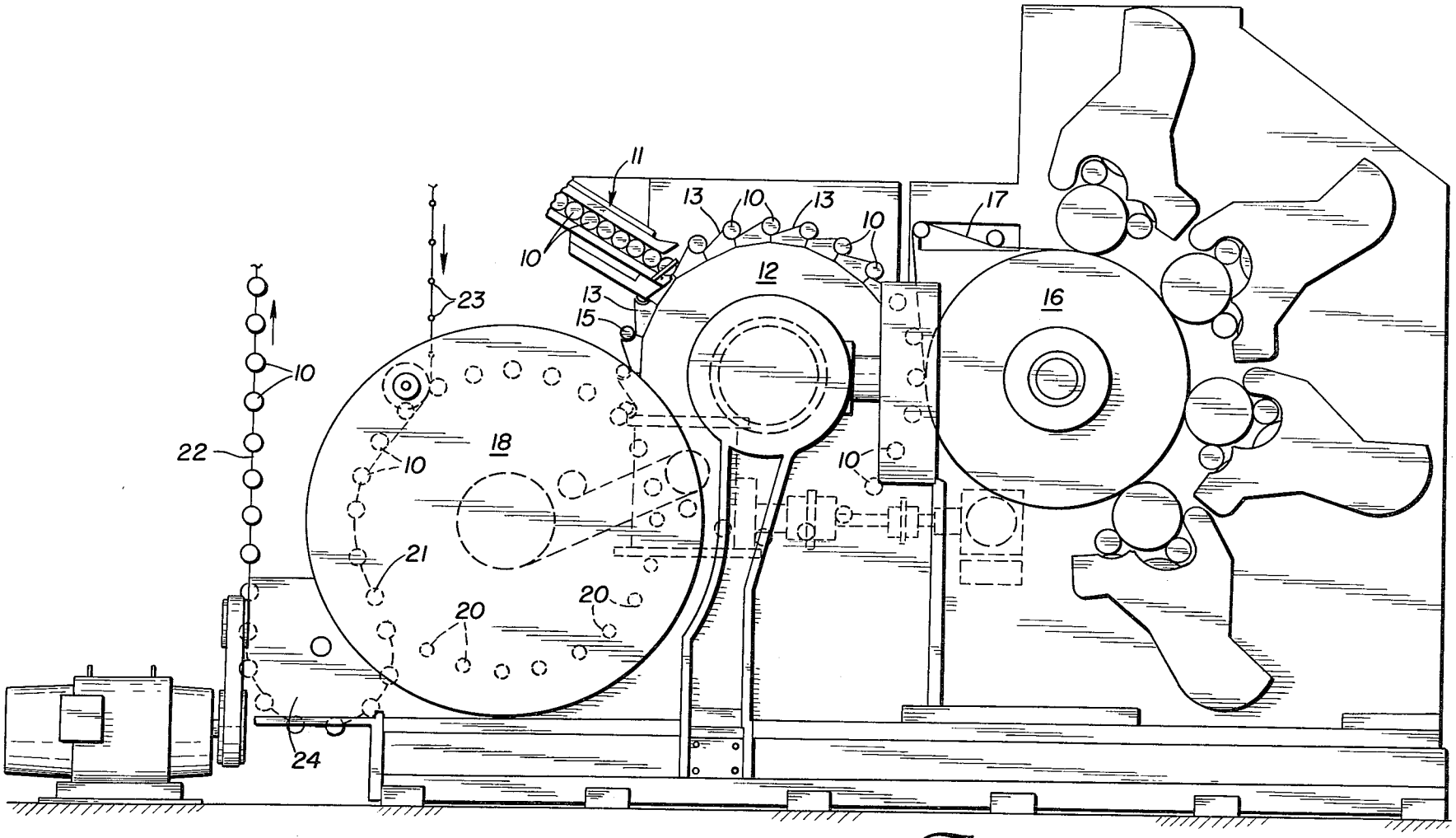
FIG. 1 is an elevational front view of a can printing or decorating machine embodying the invention.

The general embodiment of the invention is shown in FIG. 1, where cans 10 are fed through infeed chute 11 to pocket mandrel wheel 12. In the embodiment shown, the mandrel turret carries twenty four pockets 13 and twenty four associated mandrels 15, although other numbers may be used. Each pocket 13 receives a can 10 that is then transferred to the associated mandrel 15, which supports the can for the printing operation. Pocket mandrel wheel 12 rotates to bring each can in contact with printing blanket wheel 16, which prints the exterior walls of the can as the mandrel rotates to expose the circumference of the can to the blanket. Belt 17 is powered by the printing blanket wheel 16 and contacts each mandrel to cause it to rotate in perfect synchronization with the surface of the printing blanket wheel resulting in a smudge-free printing of the can body. Following the printing operation the pocket mandrel wheel 12 carries the printed can to a transfer wheel 18 where the cans are blown from the mandrel onto suction cups 20, and in the transfer area 21 the suction cups guide the can onto pin chain conveyor 22 as pins 23 are moved through the transfer area 21 by chain drive 24.

The invention comprises mechanism for tripping any mandrel without a can or with an improperly mounted can so that the printing blanket wheel 16 will not be contacted by a bare mandrel or by an improperly seated can. A tripped mandrel is moved out of the line of rotation for printing far enough that neither the mandrel nor an improperly seated can will contact the printing blanket.

Figure 2:
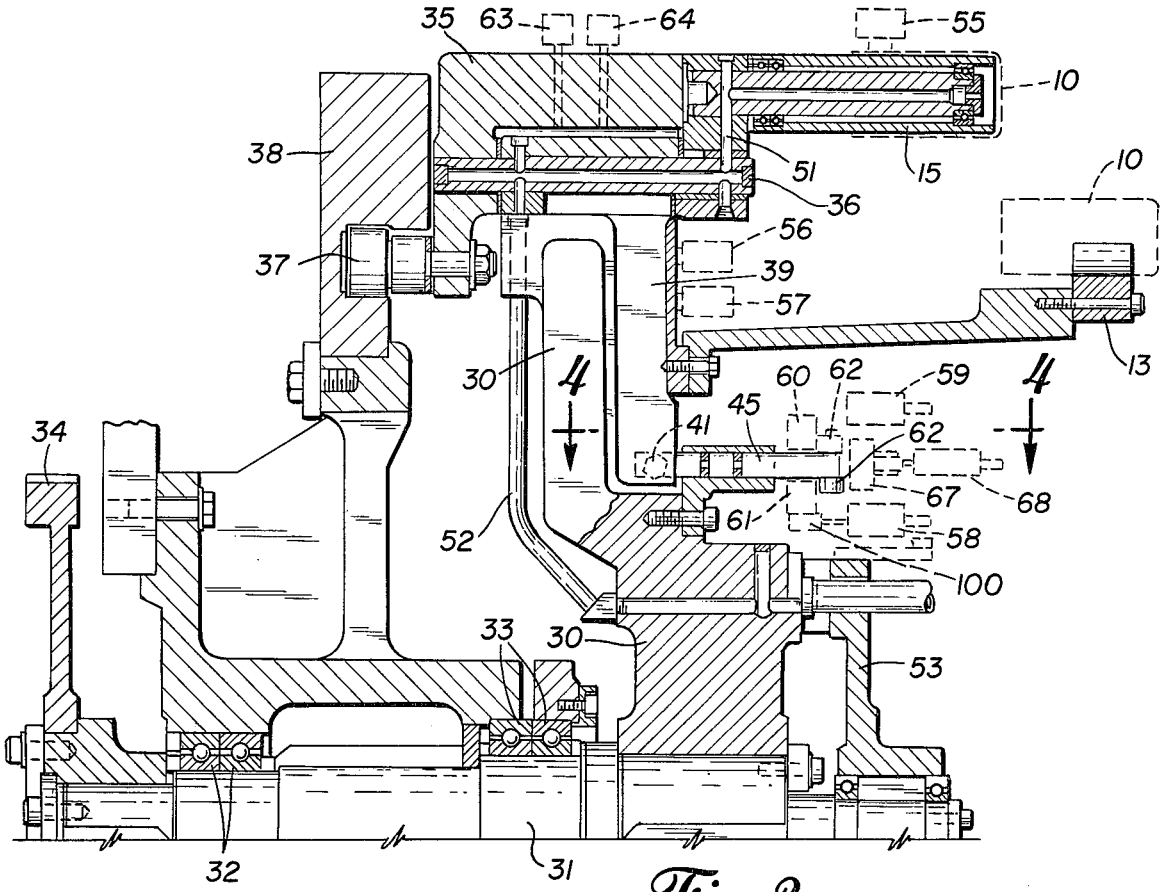
FIG. 2 is a transverse vertical sectional view, partly diagrammatic, of the pocket mandrel wheel of FIG. 1, showing one of similar mandrels, mandrel arms and pivot arms which are parts of the mandrel tripping mechanism.

In FIG. 2, the mandrels 15 and pockets 13 with their associated mechanism are mounted on disc 30 of pocket mandrel wheel 12, and the disc is keyed to shaft 31 supported on bearings 32 and 33. The shaft 31 is driven in a continuous rotating motion by gear 34 through an appropriate drive means.

Figure 3:
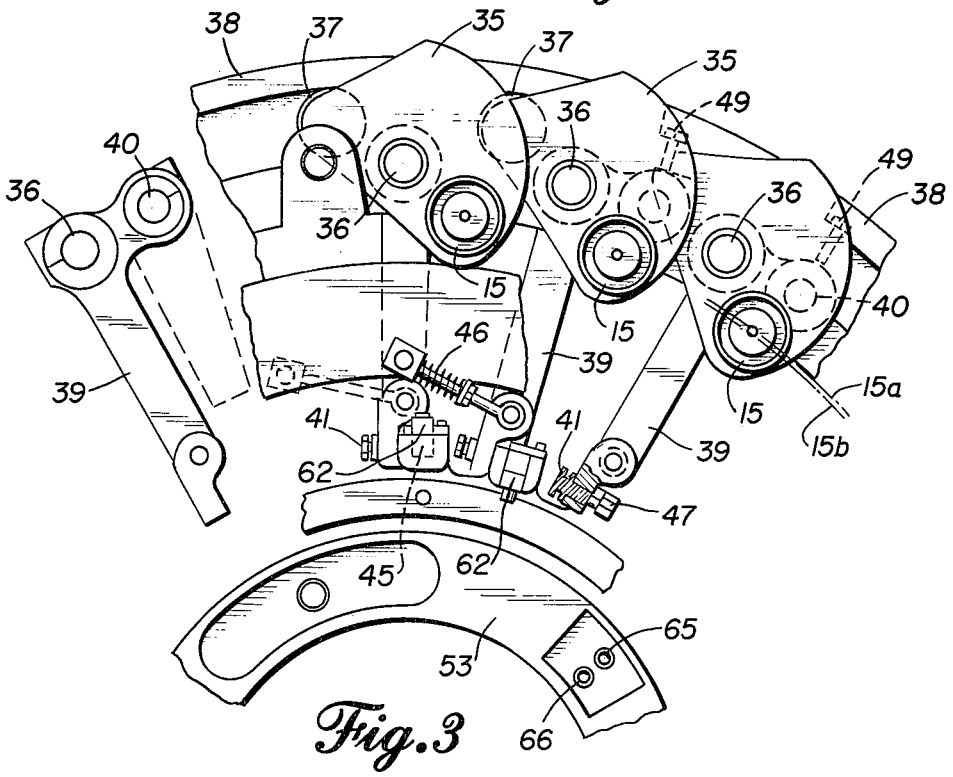
FIG. 3 is an elevational view showing three mandrel arms of FIG. 2 in different positions.

As best shown in FIG. 3, each mandrel 15 is mounted on mandrel arm 35 which pivots around center 36. The pivoting motion is induced by a guide means here shown as cam follower 37 attached to the same mandrel arm 35 and working in box cam 38. Pivot point 36 is contained in pivot arm 39, which is pivotally held by disc 30 through pin 40.

In operation, when pivot arm 39 is made to move (i.e. pivot about center 40), pivot center 36 will be displaced and consequently mandrel 15 will be displaced also. At this moment, mandrel arm 35 pivots substantially around center 36 and as the illustrated distance 37-36 is approximately equal to 36-15, the displacement of the mandrel 15 is about twice the displacement of pivot center 36. The preferred mandrel displacement is approximately 0.180 in. The normal position of pivot center 36 holds the mandrel 15 in a position to exactly track the blanket wheel 16 for printing.

Figure 4:
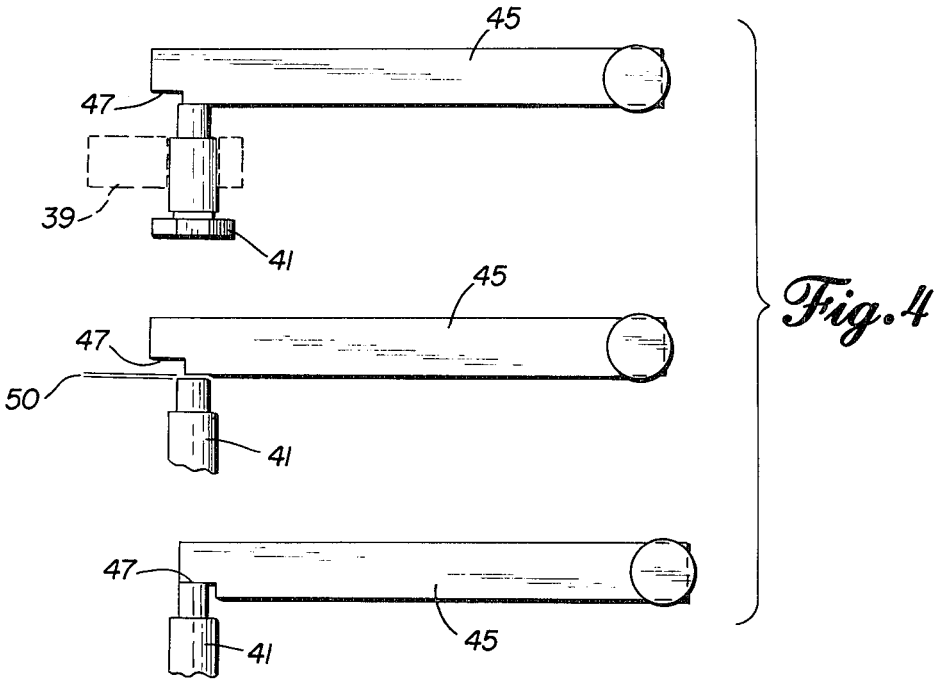
FIG. 4 is an elevational view, taken along line 4—4 of FIG. 2 of the interposer block in three positions relatively to an adjusting screw on the mandrel pivot arm of a mandrel.
Figure 5:
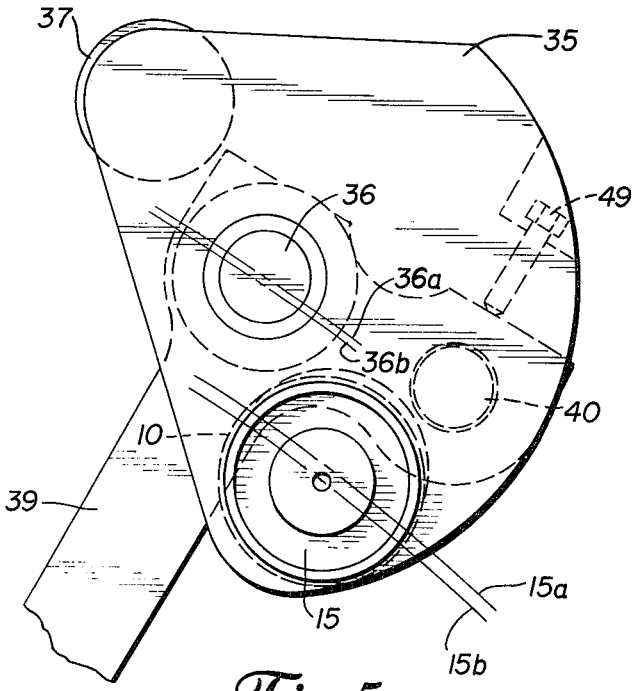
FIG. 5 is an elevational view of one of the mandrel arms and pivot arms illustrating the movement of the mandrel and its mandrel arm in the tripping movement of the mandrel.

Pivot center 36 is held in position by holding means acting on the radially inwardly extended portion of pivot arm 39. The preferred means of support is adjusting screw 41 carried in the end of pivot arm 39 and normally resting on interposer block 45. Resilient means, here shown as spring 46, hold the adjusting screw 41 against the interposer block 45. As seen in FIG. 4, the interposer block 45 has a step of 3/16 in. at its end. Normally, adjusting screw 41 rests on the full portion of the block 45. If the block is made to move to the right, the adjusting screw will rest on the recessed portion 47 of the block, thus moving the end of arm 39 by 3/16 in. In FIGS. 3 and 5 this 3/16 in. travel is the movement that arm 39 makes which at point 36 corresponds to the movement from **36-*a* to 36-*b*, and consequently the movement of the mandrel from 15-*a* to 15-*b*. When center 36 is so displaced, the mandrel 15 still tracks the blanket wheel 16** but is 0.180 in. away from it. This mandrel will not print.

To ensure free movement of interposer block 45, the pressure of adjusting screw 41 is relieved just prior to the displacement of the block to the right in the following manner: adjusting screw 41 is lifted off of interposer block 45 by means for overcoming the pressure of spring 46. In FIGS. 3 and 5, mandrel arm 35 carries contacting means, for example screw 49, which is so positioned that during most of the pivoting motions of the mandrel 15 it stays clear of contact with any part of the machine. Just prior to the tripping cycle the cam 38 rotates mandrel arm 35 in the clockwise direction to bring screw 49 in contact with the pivot arm 39 as illustrated in FIGS. 3 and 5. Camming is continued for a few thousandths of an inch and since mandrel arm 35 can no longer pivot freely, this camming causes both the mandrel arm 35 and pivot arm 39 to pivot around the only degree of freedom available around center pin 40, creating a gap 50 between adjusting screw 41 and interposer block 45. After the interposer block is moved to the right in FIGS. 2 and 4, camming is reversed and its action makes pivot arm 39 pivot in the opposite direction until adjusting screw 41 rests on the recessed portion 47 of interposer block 45.

Each mandrel is connected through a series of internal channels 51 and hose 52 to manifolds 53. These manifolds supply vacuum or air as required in the cycle of operation. Manifold 53 is used for blow off of cans. If a can is not properly seated on the mandrel, the mandrel is tripped off and this can is ejected by air blow off to avoid possible damage to the blanket by a slightly deformed can and also preclude jamming during the next loading cycle.

In the overall operation, an electronic sensor 55 detects the cans on the mandrel at a position where all cans should be fully seated on the mandrels. The sensor is trained on the edge of the can and will therefore detect both a missing can or an improperly seated can. The signal from the sensor is relayed to an electronic system which at an appropriate time energizes one of two solenoid valves 56, 57. These valves arcuate air cylinders 58 or 59 which move trip cams 60 or 61 through connecting means 100, such as a clevis. Air cylinder 59 operates on trip cam 60 through connecting means (not shown) similar to connecting means 100 illustrated in FIG. 2 as a part of air cylinder 58 acting on trip cam 61, but the correcting means has been omitted from the drawing for clarity. The trip cams displace the interposer blocks 45 by bearing on rollers 62 attached to the interposer blocks, thereby causing the appropriate mandrel to trip. Only the mandrel with the improperly seated can is tripped while both the succeeding and preceeding mandrels, if they contain properly seated cans, remain in the printing position.

After the tripping operation, the signal from the sensor is relayed to one of two blow-off solenoid valves 63, 64 which feed air through ports 65 or 66 of manifold 53, thereby blowing off the improperly seated can. The mandrel remains tripped past the printing blanket wheel 16, but before reaching the can infeed position the interposer block is returned to its original position by means of resetting cam 67, which is actuated by its own air cylinder 68 and acts on rollers 62 attached to interposer block 45. Prior to the resetting cycle, the cam 38 brings screw 49 in contact with pivot arm 39 as previously described, raising adjusting screw 41 off of interposer block 45 to a distance that will allow the non-recessed face of interposer block 45 to be placed under the adjusting screw 41 by the action of resetting cam 67.

When the supply of cans to the pocket mandrel wheel 12 is interrupted, the machine goes into a slower idle speed mode and the mandrels trip successively, as there are no cans on the mandrels. The reset cam 67 is then made to withdraw, thereby preventing the unnecessary resetting and tripping of the mandrels.

As seen in FIGS. 2 and 3, the interposer blocks 45 have two channels of rollers 62. Similarly, there are two channels of ports 65 and 66 for blow off of cans. This feature is designed for high speed operations and allows considerable time for the electro-pneumatic system to reset.

I claim:

1. In a continuous printing machine for cylindrical containers, a cam actuated pivoting mandrel mechanism comprising:

a. a mandrel arm, b. a pivot arm pivotally mounted on said printing machine and having said mandrel arm pivotally mounted thereon, c. a can support mandrel mounted on said mandrel arm at a point non-coaxial with the mounting of the mandrel arm on the pivot arm, d. a slidable stop member mounted on the printing machine and supporting said pivot arm in a first position when a properly mounted can is on the mandrel, the stop being movable to a second position wherein the pivot arm is not supported in said first position, e. means for detecting a missing or a partially loaded can on the mandrel, and f. means for moving said slidable stop member to said second position in response to said detecting means when a missing or improperly loaded can is on the mandrel, the slidable stop member allowing the pivot arm to move from said first position and in turn move said mandrel arm and mandrel from printing position.

2. The device of claim 1, further comprising resilient means urging said pivot arm against the slidable stop when the pivot arm is in said first position, and urging the pivot arm to move into a corresponding second position when the slidable stop moves into a second position.

3. A mandrel tripping mechanism for preventing contact between a can improperly seated on a mandrel or a mandrel without a can and a printing blanket wheel, comprising:

a. a shaft, b. a disc keyed to said shaft for rotation therewith, c. a pivot arm pivotally mounted on said disc, d. a mandrel arm pivotally mounted on said pivot arm, e. a mandrel mounted on said mandrel arm non-coaxially with respect to the mounting of the mandrel arm on the pivot arm, f. means guiding the rotation of said mandrel arm about its pivotal mounting on said pivot arm, and g. means holding said pivot arm in a plurality of distinct positions of rotation about its pivotal mounting on said disc, comprising resilient means urging said pivot arm to rest against a slidable stop when a properly mounted can is on the mandrel, and means for detecting a missing or improperly mounted can on the mandrel, and moving said slidable stop to a second position, the pivot arm being urged by said resilient means into a corresponding second position, in turn moving said mandrel away from the printing blanket.

4. The mandrel tripping mechanism of claim 3, wherein the means guiding the rotation of the mandrel arm comprises:

a. a cam follower mounted on said mandrel arm, and b. a cam engaging said cam follower and guiding its motion in turn guiding the rotation of said mandrel arm and relieving forces on said pivot arm in anticipation of the mandrel being tripped.

5. The mandrel tripping mechanism of claim 3, wherein the means for holding the pivot arm in a plurality of distinct positions further comprises:

a. an adjusting screw mounted on said pivot arm; and b. wherein said slide stop is an interposer block slidably mounted on said disc in a position where it may be contacted by said adjusting screw in the course of said pivot arm's rotation about its pivotal mounting on said disc, and d. wherein said resilient means urges said adjusting screw against said interposer block.

6. The mandrel tripping mechanism of claim 5, wherein the means for holding the pivot arm in a plurality of distinct positions further comprises:

a. said interposer block having both a recessed portion and a non-recessed portion on the face contacted by said adjusting screw, b. means moving said interposer block in its slidable mounting to a position where said adjusting screw contacts the recessed face of said block, and c. means moving said interposer block in its slidable mounting to a position where said adjusting screw contacts the non-recessed face of said block.

7. The mandrel tripping mechanism of claim 5, further comprising means for lessening the holding force of said resilient means against said interposer block.

8. The mandrel tripping mechanism of claim 7, wherein the means for lessening the holding force of said resilient means comprises means mounted on said mandrel arm contacting said pivot arm in the course of rotation of the mandrel arm in response to said guide means.

9. The mandrel tripping mechanism of claim 8, wherein the contacting means is a screw mounted on said mandrel arm.

10. A mandrel tripping mechanism for preventing contact between either a can improperly seated on a mandrel or a mandrel without a can and a printing blanket wheel, comprising:

a. a pivot arm having a pivotal mounting on said printing machine and being pivotable on said mounting from a first position to a second position;

b. a mandrel arm pivotally and non-eccentrically mounted on the pivot arm, said mounting being non-coaxial with respect to the pivotal mounting of the pivot arm on the printing machine, pivoting motion of the pivot arm causing a linear displacement of the mandrel arm;

c. guide means for guiding the rotation of the mandrel arm about its mechanism on the pivot arm, said guide means pivotally connecting the mandrel arm to the printing machine and allowing the mandrel arm to undergo rotational motion with respect to the connection of the guide means in response to the movement of the pivot arm from said first to second positions;

d. a can support mandrel mounting non-coaxially on the mandrel arm with respect to both the mounting of the mandrel arm on the pivot arm and the connection of the guide means to the mandrel arm, the mandrel being held in printing position by the mandrel arm and guide means when the pivot arm is in said first position, and the mandrel being displaced from printing position by combined displacement of the mandrel arm caused by both pivoting of the pivot arm to said second position and rotation of the mandrel arm with respect to the connection of the guide means;

e. means for detecting a missing or partially loaded can on the mandrel; and f. means for moving said pivot arm from said first position to the second position in response to said detecting means when a missing or partially loaded can is on the mandrel, the motion of the pivot arm causing the mandrel arm to pivot with respect to said guide means, withdrawing the mandrel from printing position.

* * * * *